US008743163B2

(12) United States Patent
Harris et al.

(10) Patent No.: US 8,743,163 B2
(45) Date of Patent: Jun. 3, 2014

(54) PRINTING METHOD FOR REDUCING PRINTER ARTIFACTS

(75) Inventors: Mark Anthony Harris, Rochester, NY (US); Richard Steven Paoletti, Spencerport, NY (US); Richard William Bauer, Jr., Webster, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 13/422,045

(22) Filed: Mar. 16, 2012

(65) Prior Publication Data

US 2013/0242027 A1 Sep. 19, 2013

(51) Int. Cl.
*B41J 2/32* (2006.01)
*B41J 3/60* (2006.01)

(52) U.S. Cl.
USPC ..... 347/171; 347/212

(58) Field of Classification Search
USPC ..... 347/212, 171, 172, 174, 176; 400/82, 400/188, 120.01, 120.02, 120.18
See application file for complete search history.

(56) References Cited

U.S. PATENT DOCUMENTS

| | | | | |
|---|---|---|---|---|
| 4,542,387 A * | 9/1985 | Nagashima et al. | ..... | 347/172 |
| 5,284,816 A * | 2/1994 | Stephenson | ..... | 503/227 |
| 6,784,906 B2 * | 8/2004 | Long et al. | ..... | 347/171 |

FOREIGN PATENT DOCUMENTS

| | | | | |
|---|---|---|---|---|
| JP | 58-140275 | * | 8/1983 | |
| JP | 59-155081 | * | 9/1984 | |
| JP | 61-173957 | * | 8/1986 | ..... B41J 29/00 |
| JP | 61-206683 | * | 9/1986 | ..... B41J 29/00 |

* cited by examiner

*Primary Examiner* — Huan Tran

(74) *Attorney, Agent, or Firm* — Hogan Lovells US LLP

(57) ABSTRACT

A printing method comprising a printhead and rollers for printing. A page of a print job is printed which causes depressions in the non-printed side of the print medium. The print medium is heated to reduce the depressions before printing the non-printed side.

12 Claims, 7 Drawing Sheets

| Fuser roller temperature ( °C ) | Line speed (mm/sec) | Acceptable surface after fusing | Observations |
|---|---|---|---|
| 120 | 35 | yes | |
| 120 | 70 | yes | |
| 135 | 35 | no | blisters on DRL |
| 135 | 70 | yes | |
| 150 | 70 | yes | |
| 150 | 52 | no | blisters on DRL |
| 150 | 61 | yes | |

FIG. 4

| Layer | Approximate Thickness (microns) |
|---|---|
| Thermal Dye Receiving Layer | 1 - 3 |
| Antistatic Subbing Layer | < 1 |
| Voided Film Layer | 35 - 40 |
| Film Tie Layer | 5 - 10 |
| Paper Base | 120-130 |
| Film Tie Layer | 5 - 10 |
| Voided Film Layer | 35 - 40 |
| Antistatic Subbing Layer | < 1 |
| Thermal Dye Receiving Layer | 1 - 3 |
| Total | 201 - 236 |

PRINTING METHOD FOR REDUCING PRINTER ARTIFACTS

CROSS REFERENCE TO RELATED APPLICATIONS

U.S. patent application Ser. No. 13/422,089, entitled "Printing System for Reducing Printer Artifacts", filed concurrently herewith is assigned to the same assignee hereof, Kodak Alaris Inc. of Rochester, N.Y., and contains subject matter related, in certain respect, to the subject matter of the present application. The above-identified patent application is incorporated herein by reference in its entirety.

FIELD OF THE INVENTION

The present invention is directed to thermal printing, in particular, to heat treatment of a dye receiver layer surface exposed to a capstan roller to reduce print density differential.

BACKGROUND OF THE INVENTION

It is a well known practice within dye diffusion thermal transfer printers that, in order to controllably drive the paper and maintain traction for precise image registration between color passes, an aggressively textured drive roller, and a companion pinch roller that applies a load between the paper and drive roller, is commonly used. This type of drive system does not result in any image artifacts on the printed paper when printing only on one side, or simplex printing, because the aggressively textured drive roller is not contacting the printed side of the paper. This method does present a problem when printing a two-sided, or duplex print because the aggressively textured drive roller must contact both sides of the printed sheet. For two-sided or duplex printing, the paper surface that is in contact with the aggressively textured surface of the drive roller may become compromised by the aggressively textured surface. This compromised paper surface may not receive dye transfer as readily, resulting in a visible density difference between the area of the paper that saw contact with the drive roller's aggressive texture and the area that did not contact the aggressive texture.

It is also common practice within the dye diffusion thermal transfer printer firmware to incorporate compensation algorithms that correct for across the page density variations, and/or down the page density variations. There may be limitations within the printer hardware or printer firmware such that compensation algorithms cannot completely compensate for printing artifacts generated by the drive roller. Due to these limitations, it becomes important to minimize the deviations in a print medium surface caused by the textured drive roller contacting the medium.

With respect to FIG. 1, for two-sided or duplex dye diffusion thermal transfer printing, a common method is to use two thermal print heads 102, 109, by first driving the rolled print medium 106 via drive roller (or capstan roller) 105 and pinch roller 104, in cooperation with a motor drive (not shown) on roll 106, to between platen roller 112 and one thermal print head 102 (print medium path of travel is shown in solid line), and printing on one side, Side A, of the print medium using dye donor 101. A length of print medium received from print medium roll 106 driven through the drive roller 105 and pinch roller 104 exposes Side B to come into contact with the drive roller's surface texture, compromising the Side B surface for subsequent printing. The Side B surface is compromised via the textured drive roller 105 perforating, forming depressions, pitting, or indenting the outermost layer, or more layers, of the Side B surface. The print media is then re-positioned by reversing drive roller 105 and pinch roller 104 in cooperation with the motor drive on roll 106, so that the lead edge of the paper is retracted toward the supply roll 106 and then diverted to the path represented by the dashed line. The rolled print medium 106 is driven via drive roller (or capstan roller) 105, pinch roller 107, in cooperation with the motor drive on roll 106, to between platen roller 111 and the second thermal print head 109. The non-printed surface, Side B, of the print medium is then printed using dye donor 110.

SUMMARY OF THE INVENTION

A preferred embodiment of the present patent application comprises a method of printing comprising receiving a two-sided medium in a printer, printing on a first side of the medium, smoothing a second side of the medium after printing the first side and, while the medium remains in the printer, printing on the second side of the medium. The smoothing is accomplished by heating the second side of the medium by compressing the medium against a heated surface which can be implemented as a heated roller. A plurality of rollers can be used wherein at least one of the plurality of rollers is heated and wherein the print medium is pressed against the heated roller. As in a fuser from an electrophotographic printer, a heated roller can be implemented similarly with an electric current passing through the roller for generating heat.

Another preferred embodiment of the present invention comprises a method of printing by receiving a duplex printing medium inside a printer, including using a textured roller pressed against a first side of the duplex printing medium for drawing the printing medium into the printer. A second side of the printing medium is printed including using a thermal print head. Smoothing the first side of the duplex printing medium, after the step of printing on the second side of the duplex printing medium, causes a size of indentations in the first side of the duplex printing medium to be reduced. After the depression reduction, the first side of the duplex printing medium is printed.

Another preferred embodiment of the present invention comprises a method of handling a printing medium comprising pulling the printing medium through a nip formed between a pinch roller and a textured capstan roller, wherein the capstan roller compromises a capability of one side of the printing medium to receive donor dye applied by a thermal print head to the one side of the printing medium by forming a plurality of indentations thereon. The one side of the printing medium is smoothed after the step of pulling the printing medium by heating the one side of the printing medium. This is accomplished by pulling the printing medium through a nip formed by a pinch roller and a heated roller.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

BRIEF DESCRIPTION OF THE DRAWINGS

Preferred embodiments of the present invention will be more readily understood from the detailed description of exemplary embodiments presented below considered in conjunction with the attached drawings, of which:

FIG. 4 illustrates experimental conditions used in a test fuser and the corresponding observations of a dye receiving layer's surface quality.

DETAILED DESCRIPTION OF THE INVENTION

Figure 1:
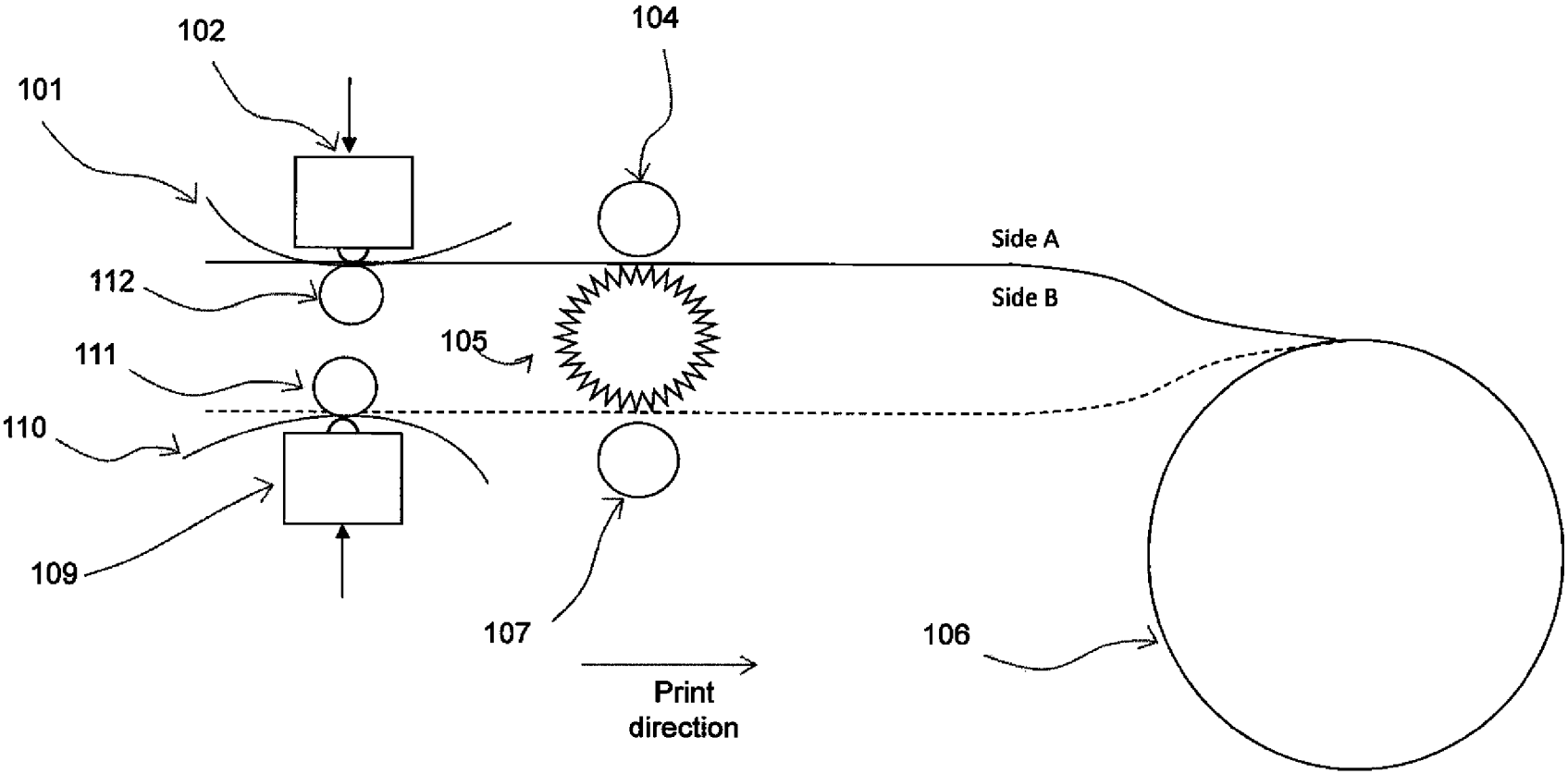
FIG. 1 illustrates duplex printing in a thermal printer apparatus.
Figure 2:
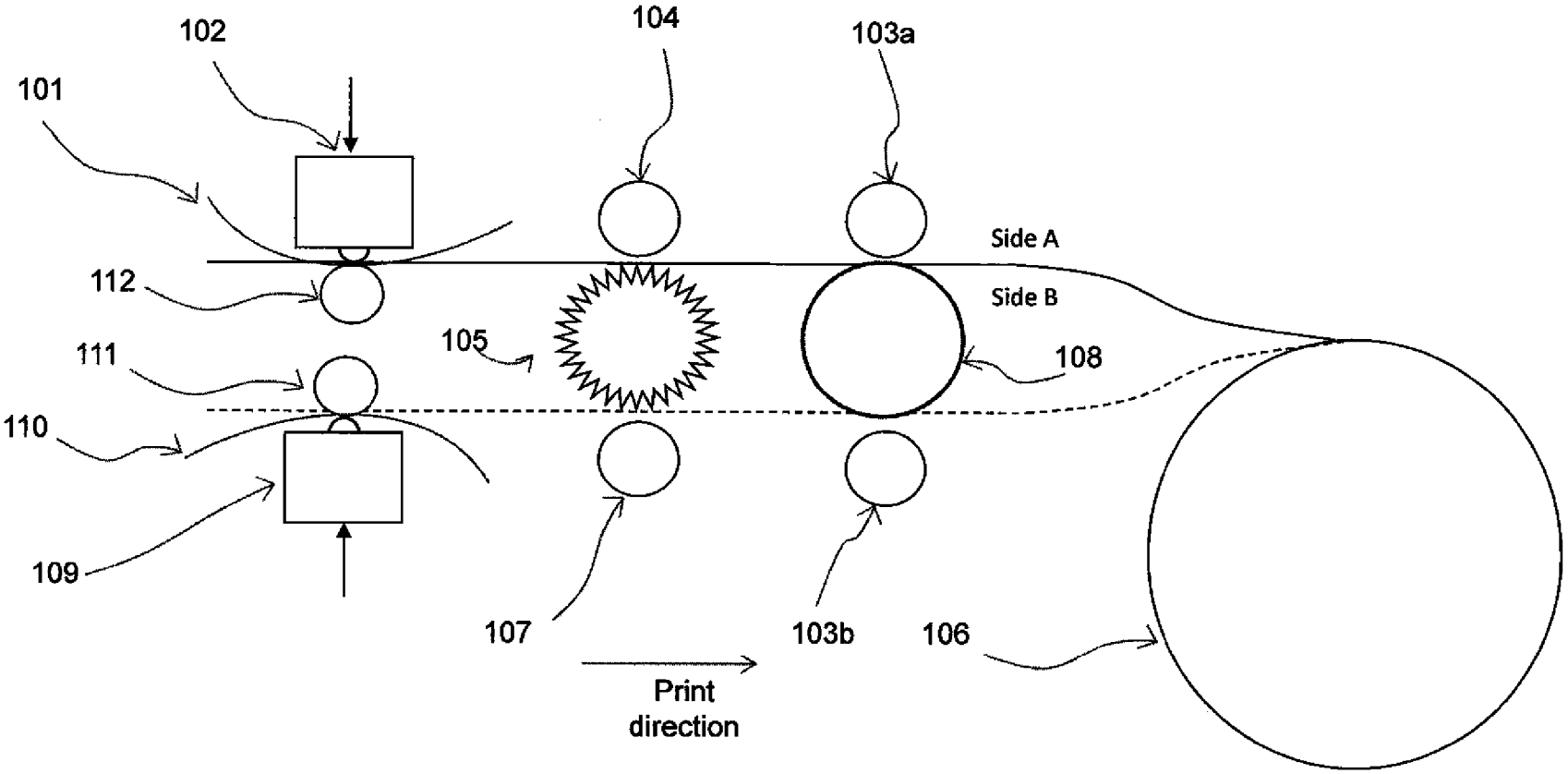
FIG. 2 illustrates a print medium positioned in a modified thermal printer apparatus.
Figure 3A:
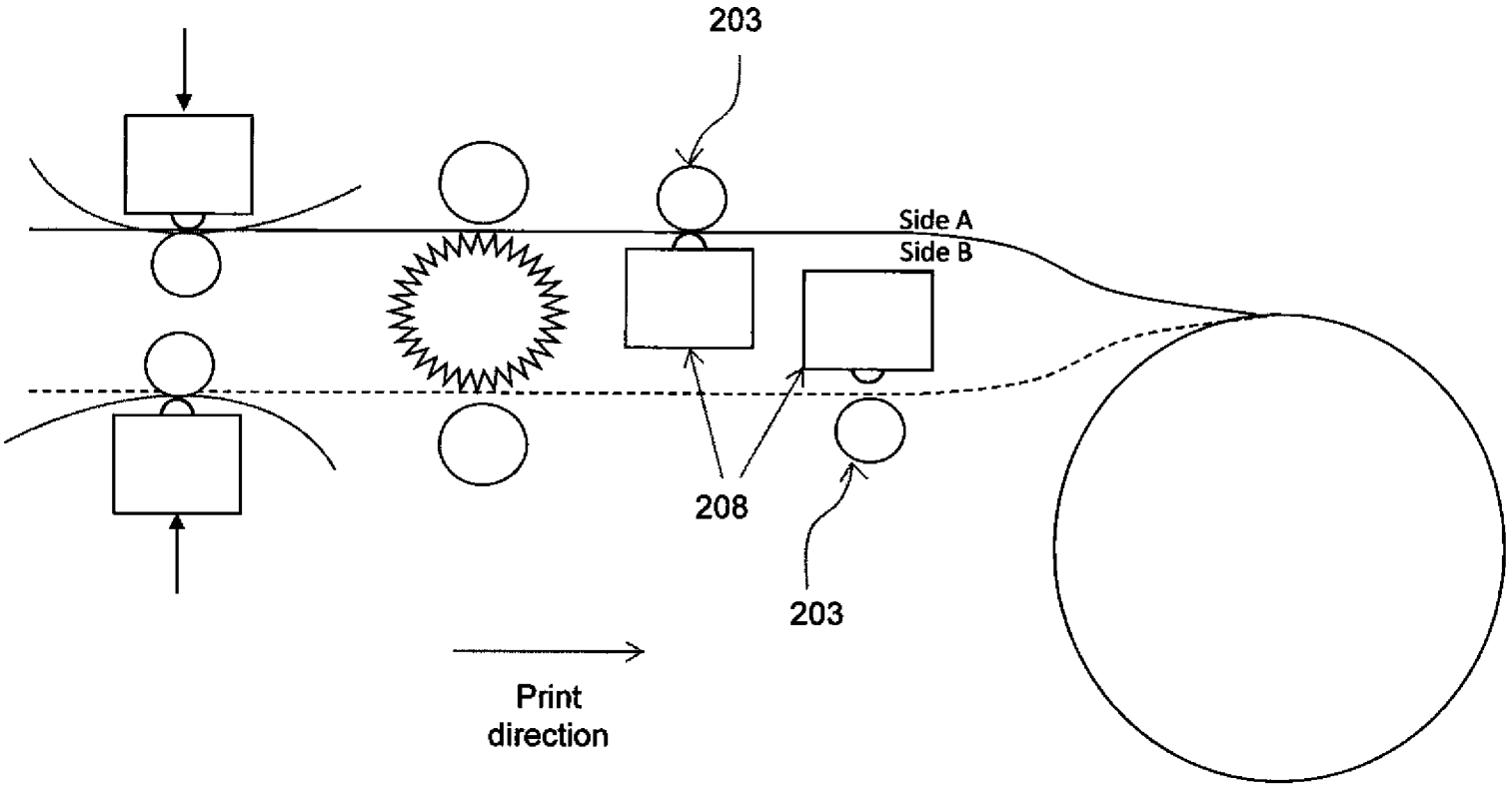
FIG. 3 illustrates a print medium positioned in an alternative modified thermal printer apparatus.

A preferred method and apparatus for printing is described in detail herein, and is illustrated in FIG. 2 wherein components common to FIG. 1 are operable as described above. After completion of printing on print medium Side A as described above, as the print media is being retracted toward the supply roll 106, the pressure roller 103*a* will press the print medium against heated roller 108 and the combination of heat and pressure will reduce a size of the depressed points of the Side B surface left by the drive roller 105. The printer is also operable in a reverse sequence as described herein wherein Side B is printed first and Side A depressions formed by drive roller 105 are reduced by compression between pressure roller 103*b* and heated roller 108. FIG. 2 shows pressure roller 103*a* forming a nip with heated roller 108, however, both pressure rollers 103*a* and 103*b* are moveable to and from a position against heated roller 108 to form a nip therewith as needed. The heating roller is similar to a fuser roller used in electrophotographic printers which uses an electric current passing through the roller for heating or, in an alternative preferred embodiment (FIGS. 3A and 3B), the heating devices comprise two additional thermal print heads 208 and platen rollers 203 whose sole purpose is to smooth the printing medium surface. The heating devices are operable to heal the printing medium according to the present invention if disposed as illustrated in FIG. 3A or as illustrated in FIG. 3B.

Figure 3B:
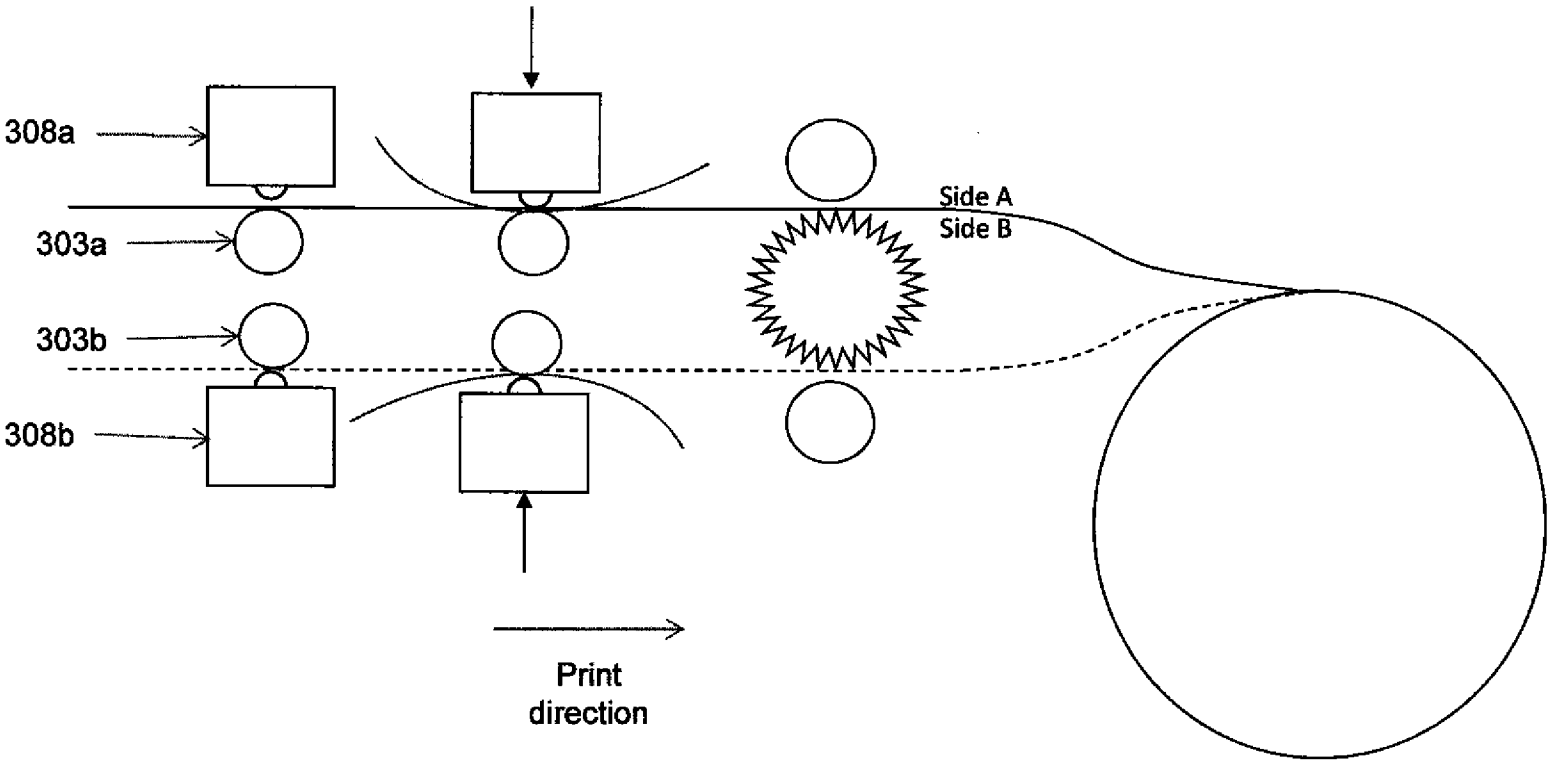

With reference to FIG. 3B, after completion of printing on print medium Side A as described above, the print media is retracted toward the supply roll, as before, and then diverted along the pathway represented by the dashed line. The capstan and pinch roller drive the print medium between the printhead and platen roller such that a length of the print medium extends beyond the printhead. This is because the print medium is pulled from left to right, as shown in the Figures, during the thermal printing step. At this point, while the print medium is extended beyond the printhead and platen roller and is being pulled toward the printhead for printing, the pressure roller 303*b* will press the print medium against heated roller 308*b* and the combination of heat and pressure will reduce a size of the depressed points of the Side B surface left by the drive roller. The printer is also operable in a reverse sequence wherein Side B is printed first and Side A depressions formed by the drive roller are reduced by compression between pressure roller 303*a* and heated roller 308*a* prior to printing Side A.

It is known from experimentation that, during the printing operation described above, holes, depressions, perforations, or indentations are created by the capstan roller on the side opposite to the side being printed. These holes are crescent shaped indentations in the outer dye receiver layer (DRL). Depending on the type of media, these holes might penetrate the DRL resulting in perforations in the DRL. Because the DRL is a flexible layer, it may be indented or perforated by the drive roller. Whether the DRL is indented or perforated by the drive roller, the heating step improves the DRL surface for receiving the dye donor and results in improved print quality. It should be noted that some duplex thermal printer designs are envisioned without a textured drive roller. Rather, a smooth drive roller is used with increased pressure against the pinch roller to compensate for lost traction due to lack of an aggressive texture on the drive roller. This increased pressure can also cause depressions or indentations, i.e. "tracks", in the duplex receiver resulting in across the page density variations. The embodiments of the invention disclosed herein also serve to correct for these variations.

Figure 6:
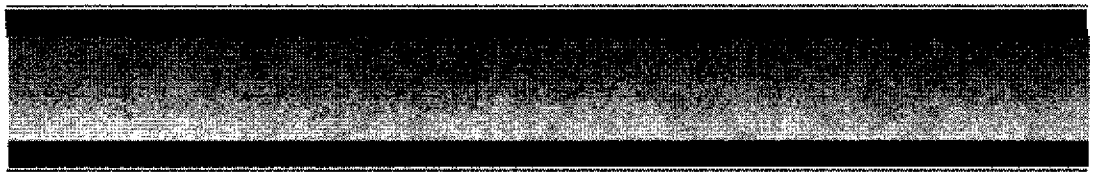
FIG. 6 illustrates a duplex receiver layer structure with thicknesses.

With reference to FIG. 6, there is illustrated the thicknesses of various layers in the duplex receiver structure 601 contemplated by a preferred embodiment of the present invention. Other duplex receiver materials may be similarly improved with use of the embodiments of the present invention. The textured drive roller typically comprises protrusions extending from its cylindrical surface at a distance of about 25 microns.

When this compromised DRL surface is printed the print density at areas corresponding to the capstan roller is lower than the print density found in the rest of the print. It was hypothesized (and observed by microscopy) that the holes do not get filled up with dye as intended by a thermal printing step and hence the half tone effect results in visibly lower print density. A two sided thermal receiver (medium) comprising a voided biaxially oriented polypropylene laminate was run through once for testing purposes. The one time run through means that the receiver was pulled or driven through the capstan rollers one time without printing. Experiments evaluated the effect of heat treatment on the unprinted DRL surface exposed to the capstan roller. The heat treatment was applied using an electrophotographic fuser breadboard. This breadboard allows temperature and line speed to be changed at a constant pressure between the nip formed by the heated roller 108 and pressure roller 103*a* or 103*b*, which is an elastomer nip. The measured nip width using a pressure sensitive medium was 5 mm. This width is measured lengthwise along the print medium and is formed by the pressure of the heated roller against the compliant pressure roller with the print medium therebetween. Increased pressure increases the nip width as would a larger diameter heated roller, a larger diameter compliant pressure roller, or if either roller was made to be more compliant. Increased nip width increases an amount of heat transferred to the print medium. Typical pressure rollers are steel core with a thick silicone rubber layer, and a thin Teflon coating as an outer layer. The heated roller is similar in design to a fuser roller used in most electro-photographic printers.

Figure 5:
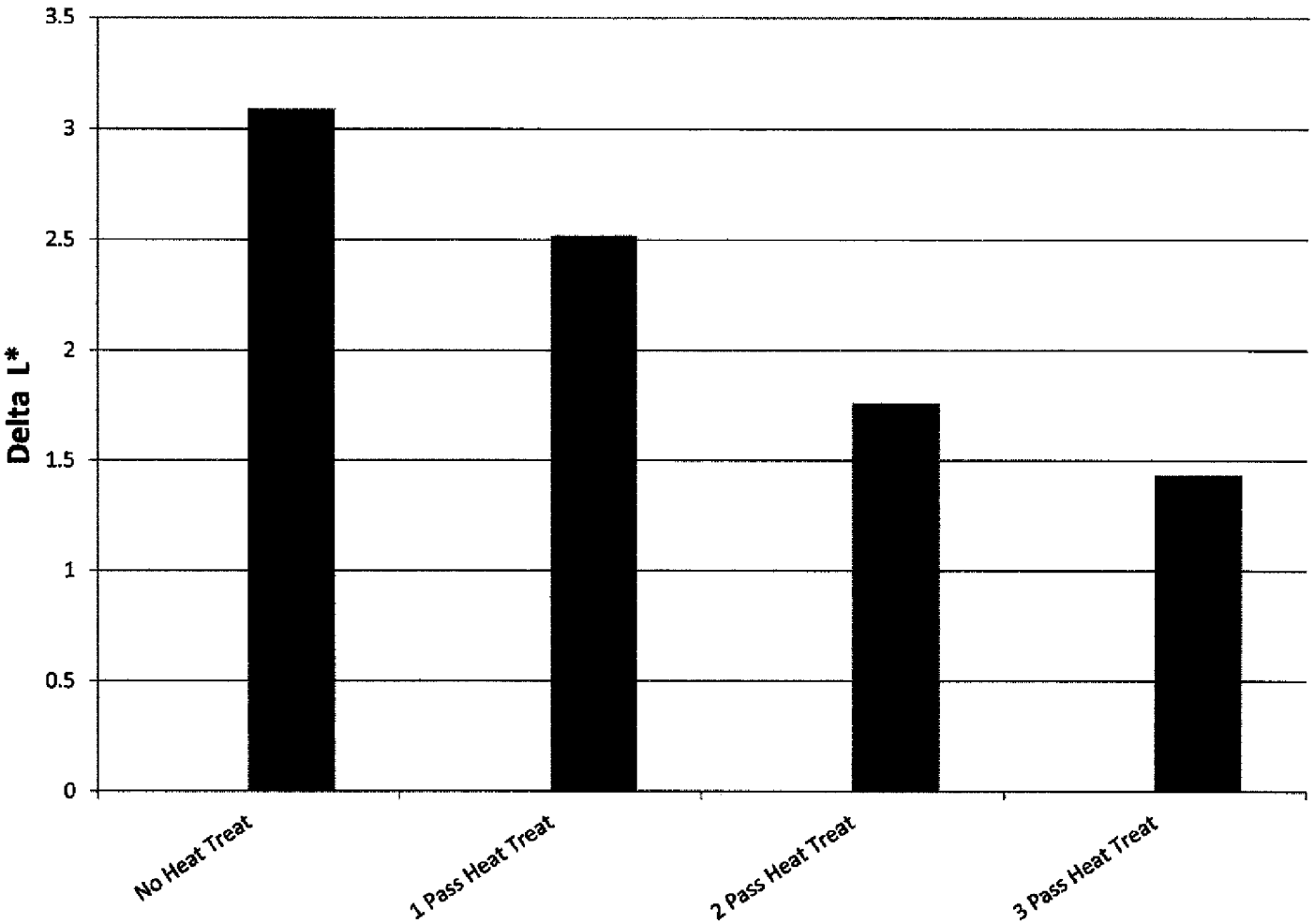
FIG. 5 illustrates test results of dye receiving layer under heat treatment according to embodiments of the present invention.

Ten feet of each variation was created to enable testing the heated capstan roller exposed DRL side in the printer. Observations were recorded as illustrated in FIG. 4. For a given temperature and line speed condition (e.g., 150 C, 70 mm/sec) the print medium (receiver) was run twice and thrice through the nip. We consider running the medium twice through a 5 mm nip as equivalent to exposing the medium to a 10 mm nip width (though in a discontinuous manner, because the receiver cools in between the heating steps) and running thrice as equivalent to exposure to a 15 mm of nip width (though in a discontinuous manner, as above). FIG. 5 highlights difference in Delta L* (ΔL*) between a capstan roller compromised area of the print medium and a capstan-untouched portion of the print medium. L* is an arbitrary relative measure of lightness and the changes in L* shown in the graph of FIG. 5 should be interpreted relative to the other measured magnitudes. The magnitudes are measured using a densitometer. It is observed that samples with heat treatment (150° C., 70 mm/s) shows lower ΔL*, i.e. there is less visible difference between untouched medium and a capstan compromised medium.

Heat treatment shows promise in healing the capstan roller marks and minimizing ΔL*. Improvements in this procedure could include the ability to change pressure in the nip to enable a healing process, or to use a thermal head to heal the holes (FIG. 3). Alternative heating methods include a heating zone located between the capstan roller and the supply roll. The heating zone could comprise a heated band which does not stick to DRL. The heating zone could also contain a non-contact heating source.

The thermal dye receiving medium can be manufactured by various well known techniques and materials for duplex thermal receivers. A preferred method and materials are described in US Patent Application Publication 2011/0091667 A1, which is incorporated herein by reference in its entirety but for descriptions of a non-imaging reverse side of the print medium.

The invention has been described in detail with particular reference to certain preferred embodiments thereof, but it will be understood that variations and modifications can be effected within the spirit and scope of the invention.

PARTS LIST

101 Donor
102 Thermal Print Head
103*a* Compliant Pressure Roller
103*b* Compliant Pressure Roller
104 Pinch Roller
105 Capstan Roller
106 Paper (Medium) Roll
107 Pinch Roller
108 Heated Roller
109 Thermal Print Head
110 Donor
111 Platen Roller
112 Platen Roller
203 Platen Rollers
208 Thermal Heads

The invention claimed is:

1. A method of printing comprising:

receiving a duplex printing medium inside a printer, including using a textured roller pressed against a first side of the duplex printing medium for drawing the printing medium into the printer;

printing on a second side of the duplex printing medium including using a thermal print head;

smoothing the first side of the duplex printing medium, wherein a size of indentations in the first side of the duplex printing medium caused by the textured roller is reduced; and printing on the first side of the duplex printing medium after the step of smoothing.

2. Method of claim 1 wherein the step of smoothing comprises heating the first side of the duplex printing medium after the step of printing on the second side of the duplex printing medium.

3. Method of claim 2 wherein the step of heating comprises compressing the duplex printing medium against a heated surface.

4. Method of claim 3 wherein the step of compressing comprises using a heated roller.

5. Method of claim 4 wherein the step of using a heated roller comprises using a plurality of rollers wherein at least one of the plurality of rollers is heated.

6. Method of claim 3 further comprising heating the heated surface by passing an electric current therethrough.

7. Method of claim 6 further comprising passing the electric current through the heated surface while the duplex printing medium is being compressed against the heated surface.

8. A method of handling a printing medium comprising:

pulling the printing medium through a nip formed between a pinch roller and a textured capstan roller, wherein the capstan roller comprises a capability of one side of the printing medium to receive donor dye applied by a thermal print head to one side of the printing medium by forming a plurality of indentations thereon; and smoothing the one side of the printing medium after the step of pulling the printing medium.

9. Method of claim 8 wherein the step of smoothing comprises heating the one side of the printing medium.

10. Method of claim 9 wherein the step of heating comprises pulling the printing medium through a nip formed by a pinch roller and a heated roller.

11. Method of claim 10 wherein heated roller is heated by passing an electric current therethrough.

12. Method of claim 11 further comprising passing the electric current through the heated roller during the step of pulling the printing medium through the nip formed by the pinch roller and the heated roller.

* * * * *